US006196648B1

(12) United States Patent
Henriott

(10) Patent No.: US 6,196,648 B1
(45) Date of Patent: Mar. 6, 2001

(54) DESK SYSTEM HAVING STANCHION SUPPORTED OVERHEAD STORAGE CABINET

(75) Inventor: Jay M. Henriott, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 666 days.

(21) Appl. No.: 08/744,692

(22) Filed: Nov. 7, 1996

Related U.S. Application Data

(63) Continuation of application No. 08/391,422, filed on Feb. 16, 1995.

(51) Int. Cl.[7] ..... A47B 17/00

(52) U.S. Cl. ..... 312/196; 312/198; 312/223.6; 108/103; 108/50

(58) Field of Search ..... 312/223.6, 196, 312/198; 108/103, 50

(56) References Cited

U.S. PATENT DOCUMENTS

| | | | | |
|---|---|---|---|---|
| 948,377 | | 2/1910 | Prouty . | |
| 3,125,385 | * | 3/1964 | Freidman | 312/223.6 |
| 3,406,645 | | 10/1968 | Monroe . | |
| 3,770,334 | | 11/1973 | Weber . | |
| 3,786,765 | | 1/1974 | Burr . | |
| 3,897,855 | | 8/1975 | Patterson . | |
| 4,272,136 | | 6/1981 | Sengua . | |
| 4,475,322 | * | 10/1984 | Russo et al. | 312/223.6 |
| 4,619,486 | | 10/1986 | Hannah . | |
| 4,762,072 | | 8/1988 | Boundy . | |
| 5,092,253 | | 3/1992 | Grund . | |
| 5,094,174 | | 3/1992 | Grund . | |
| 5,130,494 | * | 7/1992 | Simonton et al. | 312/195 |
| 5,160,188 | | 11/1992 | Rorke . | |
| 5,183,319 | | 2/1993 | Pearson . | |
| 5,220,871 | | 6/1993 | Grund . | |
| 5,226,705 | | 7/1993 | Rorke . | |
| 5,269,231 | * | 12/1993 | Johnson | 108/103 |
| 5,544,593 | * | 8/1996 | Canfield et al. | 312/196 |

* cited by examiner

*Primary Examiner*—Anthony D. Barfield
(74) *Attorney, Agent, or Firm*—Baker & Daniels

(57) ABSTRACT

A desk system utilizing a plurality of stanchions that extend into and support overhead cabinets. The system includes a support structure comprising a plurality of support panels to which the stanchions are mounted. The stanchions extend through openings in the work surface and through openings in the lower panel of the overhead cabinet. The stanchions are mounted by means of fasteners to the inside rear corners of the overhead cabinet. The support structure also includes a lower raceway for running electrical and communication wiring, and this raceway is in communication with raceways defined within the stanchions by means of removable cover plates.

12 Claims, 3 Drawing Sheets

DESK SYSTEM HAVING STANCHION SUPPORTED OVERHEAD STORAGE CABINET

This application is a continuation of Ser. No. 08/391,422, filed Feb. 16, 1995.

BACKGROUND OF THE INVENTION

1. Field of the Invention

The present invention relates to modular desk systems for offices. More specifically, the field of the invention involves supporting structures for overhead storage cabinets in such desk systems.

2. Description of the Related Art

Modular desk systems are used in offices to allow flexibility in office arrangement and facilitate the interconnection of office equipment. Such modular desk systems provide wiring to the various types of equipment—telephones, computers, dictation machines, etc. Typically, work surfaces, cabinets, panels, and wiring raceways are interconnected with support structures to form the desk system. The panels extend from the floor, the work surfaces may be mounted at intermediate positions, and cabinets may be located at either the floor level or overhead, i.e., above the work surfaces.

Stanchions are used in such desk systems as support structures. The stanchions are typically made of sheet metal which are longitudinally bent to form a triangular or rectangular space in cross-section. The stanchion provides structural support for work surfaces, cabinets, and panels. The stanchions provide a rigid structure on which other components of the modular system may be attached to in order to support and interconnect the desk system.

In the prior art, the overhead cabinets typically attach to the stanchions by means of brackets supported by the stanchions and which are fastened to the underneath surface of the overhead cabinet. This increases the complexity of the mounting system, and results in support for the overhead cabinets, that is not as rigid as is desireable.

What is needed is an improved stanchion support system for mounting overhead cabinets.

SUMMARY OF THE INVENTION

The present invention involves a desk system having stanchion supports which extend into the overhead cabinet. By extending into the overhead cabinet, the stanchions provide a greater amount of support to the cabinet. Also, wiring may extend through the stanchion to allow equipment within the overhead cabinet to be conveniently coupled to the appropriate wiring system, if desires. The stanchion may be fastened directly to the overhead cabinet without the need for an additional mounting bracket.

Overhead cabinets often contain heavy materials such as books and manuals, so the cabinets often create significant stress on the support structure. The present invention advantageously positions the stanchions within the cabinet to reduce the stress on the cabinet mounting and enhance the cabinet's stability. The cabinet and the stanchions may be directly interconnected, eliminating one or several steps in the construction process. Also, the connection of the stanchions and the cabinet are hidden from view, creating a more attractive exterior for the desk system.

Also, overhead cabinets may include electrical and/or telecommunications equipment which require connection to the office's internal wiring. By using the stanchion's internal space as a conduit for such wiring, lights, radios, and other equipment in the overhead cabinet may be easily connected to the office wiring system. Wiring which is disposed in raceways at the floor level may extend upward through the stanchions into the interior of the overhead cabinet or to a position directly underneath the bottom of the cabinet to power a task light, for example. The wiring is thus hidden from view and protected from damage.

The present invention, in one form, is a desk system comprising a support structure, a work surface, and a cabinet. The work surface is mounted on the support structure, and the cabinet is disposed over the work surface. The support structure includes a stanchion extending through the work surface and into the cabinet to support the cabinet.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
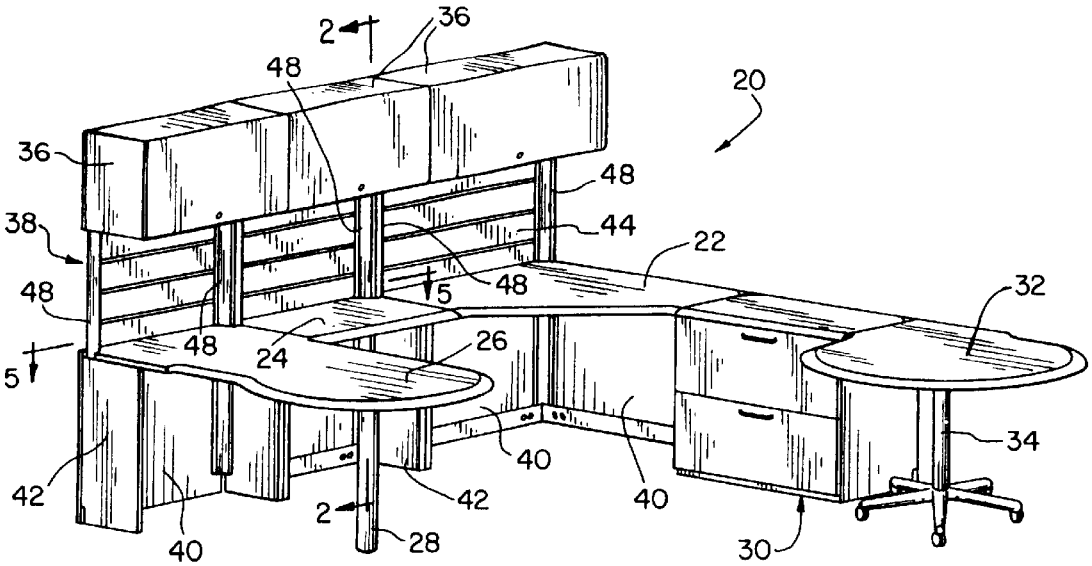
FIG. 1 is a perspective view of a desk system incorporating the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates one embodiment of the invention, in one form, and such exemplifications are not to be construed as limiting the scope of the invention in any manner.

DESCRIPTION OF THE EXEMPLARY EMBODIMENT

The embodiment disclosed below is not intended to be exhaustive or limit the invention to the precise form disclosed in the following detailed description. Rather, the embodiment is chosen and described so that others skilled in the art may utilize its teachings.

FIG. 1 depicts desk system 20 of the present invention. Desk system 20 includes work surfaces 22, 24, and 26 which provide a working surface for an office worker. Work surface 22 has a straight cornered configuration which is conventionally used to support a computer display screen (not shown). Work surface 24 has a rectangular contour and provides a connecting surface with work surface 26 having a circular extension supported by column 28. Also connected to the work surfaces are extension module 30, in the form of a file cabinet and a work surface level surface adjacent to work surface 22, and teardrop conference tabletop 32 supported by mobile table base 34. Overhead cabinets 36 are supported over work surfaces 22, 24, and 26 by support structure 38.

Figure 2:
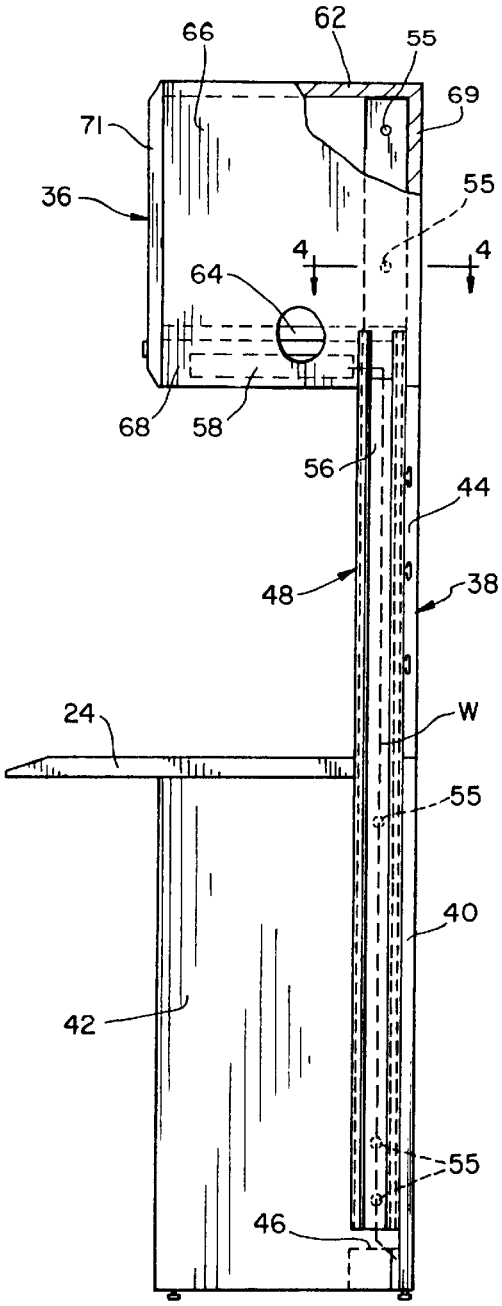
FIG. 2 is a side view of the support structure taken along view line 2—2 of FIG. 1.
Figure 3:
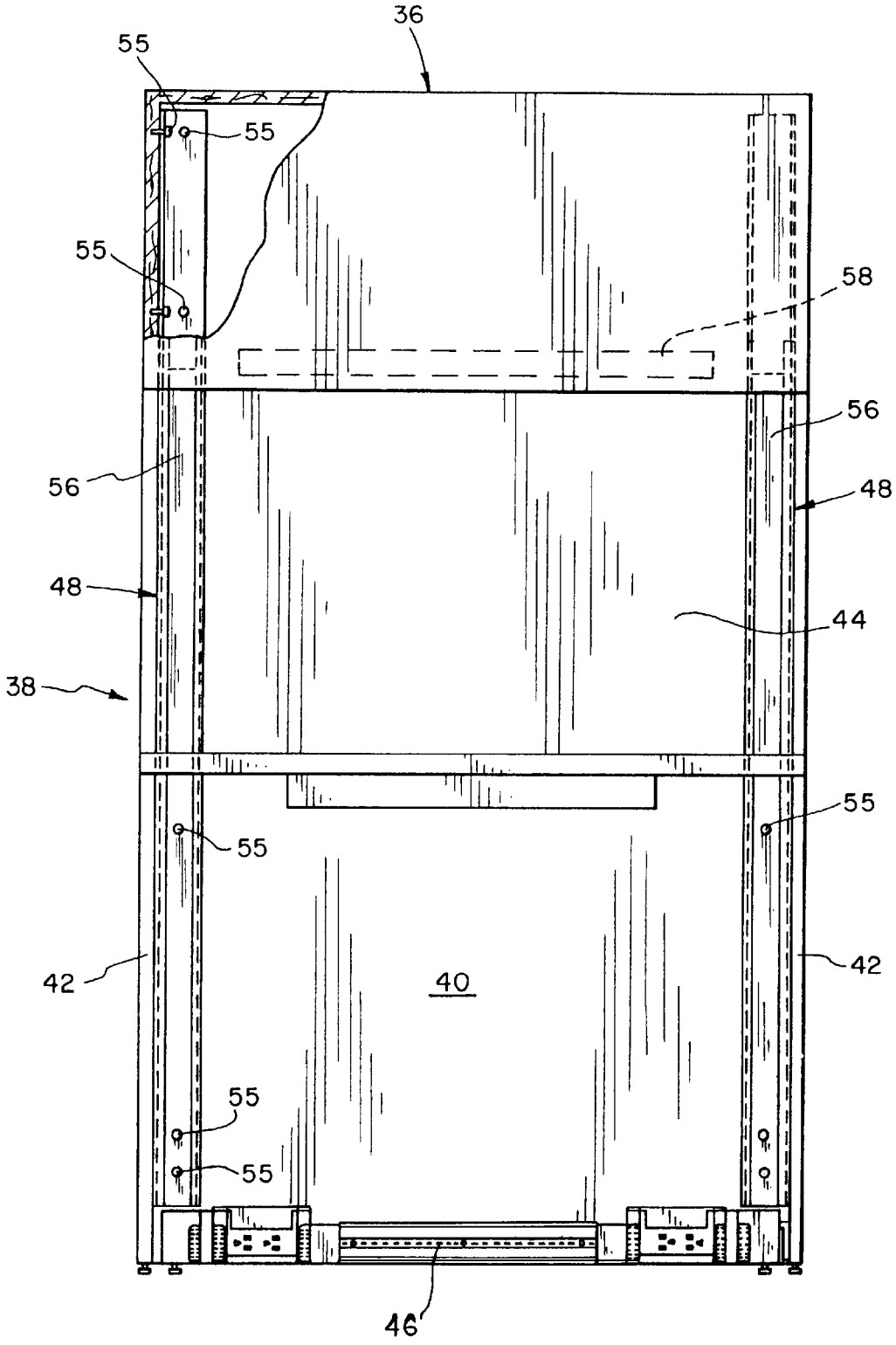
FIG. 3 is a front elevational view of a portion of the desk system.

Support structure 38 is shown in greater detail in FIGS. 2 and 3. Panels 40 and side panels 42 attach to and buttress work surfaces 22, 24, and 26. Work surfaces 22, 24, and 26 may be attached to panels 40 and side panels 42 by screws and brackets 55 to secure together the various components of support structure 38. An additional component of support structure 38, insert tile 44, may attach to the top of panel 40 and extend above work surfaces 22, 24, and 26. Insert tiles 44 may include tracks for mounting shelving or lighting accessories, or may be covered with fabric to provide a tackable vertical surface. Raceways 46 are attached to the bottom portions of panels 40 and may include electrical and telecommunications wiring, electrical outlets, telephone jacks, computer networking equipment, etc.

Figure 4:
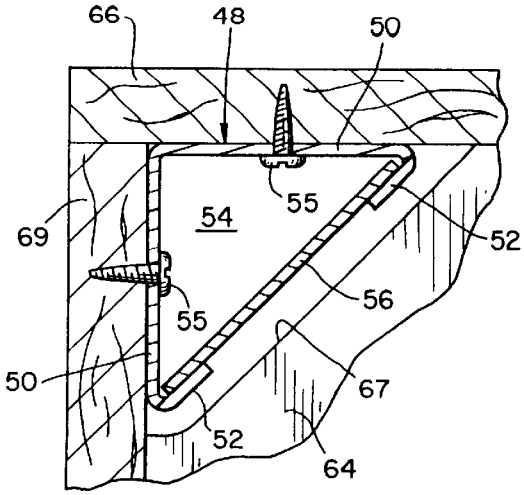
FIG. 4 is a sectional view of a stanchion of the present invention taken along line 4—4 of FIG. 2.
Figure 6:
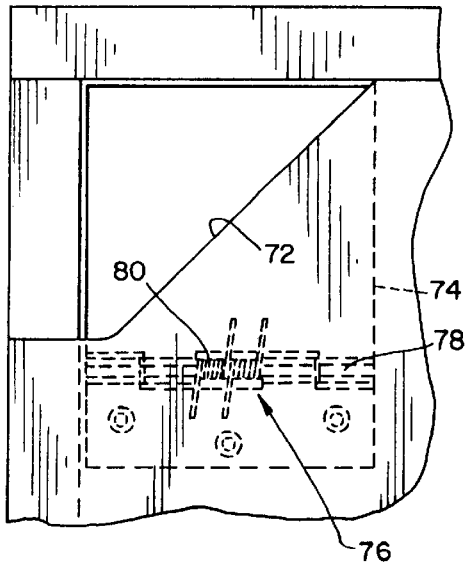
FIG. 6 is a top view of the flaps and openings of the desk.

In accordance with the present invention, FIG. 4 shows stanchion 48, which is a component of support structure 38. Stanchions 48 provide a rigid column strut attached at each side of panel 40. Stanchions 48 comprise portions 50 which are relatively disposed at about a right angle along a longitudinal axis. Stanchions 48 are attached to panels 40 by screws 55 extending through portions 50 in this exemplary embodiment. Stanchions 48 may be constructed from rolled 12 gauge steel sheet or otherwise suitably formed as a rigid structural support. Also, edge portions 52 extend from the non-adjacent ends to define a triangularly shaped interior region 54. Cover plate 56 is disposed within stanchion 48 and retained by edges 52 to conceal the interior region 54, which may carry wiring.

As best shown in FIG. 4, stanchion 48 extends through an opening 67 in cabinet bottom 64 and into overhead cabinet 36 and attaches to the rear inside corners of overhead cabinet 36 by screws 55. In the exemplary embodiment shown, task light 58 is located underneath overhead cabinet 36. Stanchion 48, near where it extends through the bottom 64 of overhead cabinet 36, includes a gap or cutout in cover plate 56 through which electrical wiring W may extend and connect with task light 58. The attachment of overhead cabinet 36 to stanchion 48 is located within overhead cabinet 36, thus concealing that connection.

Overhead cabinet 36 includes top panel 62 and bottom panel 64. Storage space is located between panels 62 and 64, and is further defined by the sides 66, back 69, and hinged door 71 of overhead cabinet 36. Located beneath panel 64 is a recessed lighting area 68, which may be bounded by the bottom edge of the sides 66, back 69, and door 71 of overhead cabinet 36.

Task light 58 could be any one of a variety of incandescent lamps, fluorescent lamps, halogen lamps, or other devices for providing illumination from lighting compartment 68 unto the upper surfaces of work surfaces 22, 24, and 26. A switch for task light 58 could be mounted in lighting area 68, along the length of cover plate 56, or another suitable location within the wiring system of desk system 20. In the embodiment shown, cover plate 56 extends to light area 68 so that wiring W within stanchion 48 may extend into lighting compartment 68 and connect with task light 58. Alternatively, cover plate 56 could include a cutout for wiring W.

Figure 5:
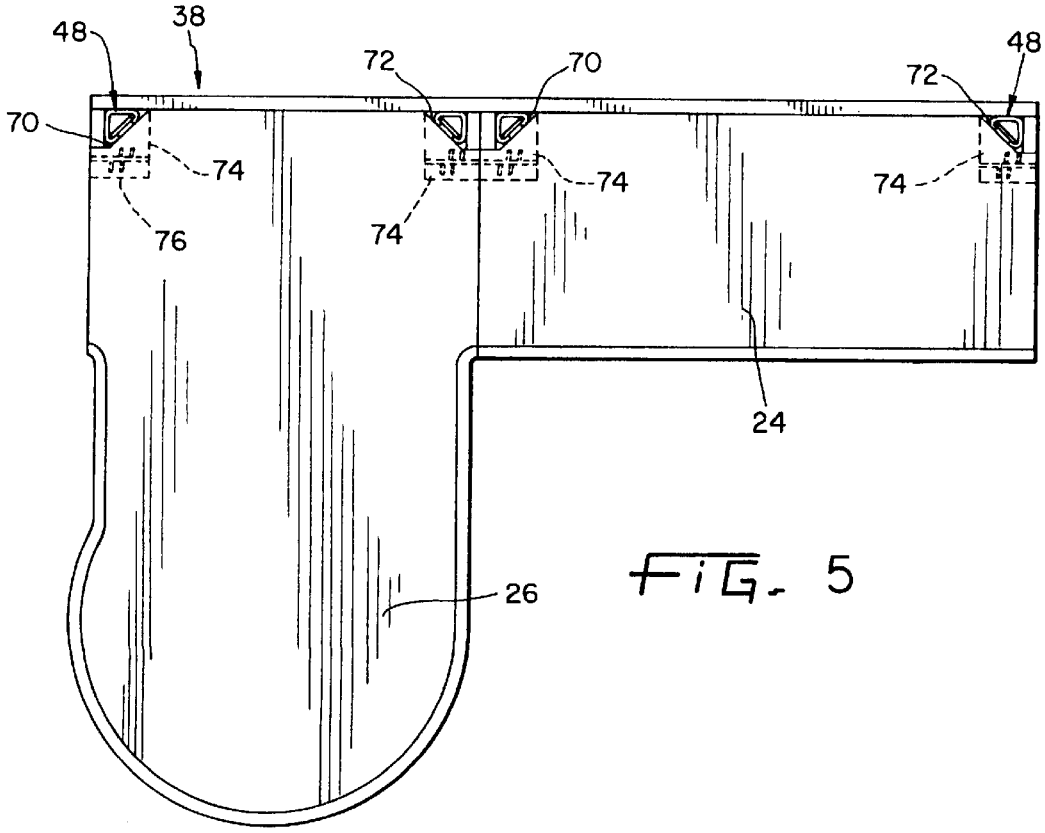
FIG. 5 is a top, partially sectional view taken along view line 5—5 of FIG. 1.

FIG. 5 shows two of the work surfaces of desk system 20 as seen from the perspective of overhead cabinets 36. Notches 70 and 72, of work surfaces 26 and 24, respectively, provide openings through which stanchions 48 extend. In the disclosed embodiment, notches 70 and 72 have a shape in the form of a triangle to accommodate the generally triangular cross-sectional shape of stanchions 48. If desired, flaps 74 can be mounted to underneath work surfaces 22–26 by means of spring hinges 76, each of which comprises a hinge rod 78 and a pair of coil springs 80. As stanchions are inserted through openings 72, flaps 74 pivot downwardly as shown in FIG. 5.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A desk system comprising:

a support structure;

a work surface mounted on said support structure; and a cabinet disposed over said work surface, said cabinet having a plurality of connected panels, said panels defining a cabinet interior adapted for the storage of items and including at least one lower panel;

said support structure including a plurality of support stanchions extending upwardly completely through said work surface and completely through said lower panel of said cabinet into the cabinet interior, said cabinet being fixedly attached to upper end portions of said stanchions, whereby said cabinet is supported on said stanchions.

2. The desk system of claim 1 wherein said support structure further comprises a first raceway for housing wiring and at least one of said stanchions defines a second raceway, said first raceway communicating with said second raceway.

3. The desk system of claim 1 wherein said cabinet interior has rear corners, and one of said stanchions extends through said lower panel at one of said rear corners.

4. The desk system of claim 1 wherein said cabinet includes a compartment housing a light fixture, said compartment located at a bottom portion of said cabinet.

5. The desk system of claim 4 wherein said fixture further comprises wiring extending from said compartment into said stanchion.

6. The desk system of claim 1 wherein said work surface includes a plurality of openings through which said stanchions extend, and further including a plurality of pivotally mounted flaps mounted beneath said openings.

7. The desk system of claim 1 wherein said plurality of stanchions is attached to said plurality of panels at locations in the cabinet interior.

8. A desk system comprising:

a support structure;

a work surface mounted on said support structure; and a cabinet disposed over said work surface, said cabinet having a plurality of connected panels, said panels defining a cabinet interior adapted for the storage of items and including at least one lower panel;

said support structure including a plurality of stanchions extending upwardly through said work surface and completely through openings in said lower panel of said cabinet into the cabinet interior, said cabinet being fixedly attached to upper end portions of said stanchions, whereby said cabinet is supported on said stanchions, and wherein a said stanchion has a triangular shape in cross-section.

9. The desk system of claim 8 wherein said stanchion includes first and second portions connected at abutting ends along an axis, said first and second portions being relatively disposed at an angle.

10. The desk system of claim 9 wherein said first and second portions have inwardly extending edges at open ends of said first and second portions.

11. The desk system of claim 10 wherein said stanchion further includes a cover plate disposed between said edges of said first and second portions.

12. A desk system comprising:

a support structure;

a work surface mounted on said support structure; and a cabinet disposed over said work surface, said cabinet having a plurality of connected panels, said panels defining a cabinet interior adapted for the storage of items and including at least one lower panel;

said support structure including a plurality of stanchions extending upwardly through said work surface and completely through openings in said lower panel of said cabinet into the cabinet interior, said cabinet being fixedly attached to upper end portions of said stanchions, whereby said cabinet is supported on said stanchions wherein said plurality of stanchions is attached to at least one vertically oriented panel of said plurality of panels at locations in the cabinet interior.

* * * * *